US005395814A

United States Patent [19]

Okimoto et al.

[11] Patent Number: 5,395,814

[45] Date of Patent: Mar. 7, 1995

[54] HEAT SENSITIVE RECORDING MATERIAL

[75] Inventors: Tomoyuki Okimoto, Takarazuka; Ritsuo Mandoh, Sakai; Katsuhiko Ishida, Kashiwa, all of Japan

[73] Assignee: New Oji Paper Co., Ltd., Tokyo, Japan

[21] Appl. No.: 202,741

[22] Filed: Feb. 28, 1994

[30] Foreign Application Priority Data

Mar. 1, 1993 [JP] Japan ..... 5-040311

[51] Int. Cl.[6] ..... B41M 5/30

[52] U.S. Cl. ..... 503/209; 503/208; 503/216; 503/217; 503/221; 503/225

[58] Field of Search ..... 427/150, 151; 503/208, 503/216, 209, 217, 221, 225

[56] References Cited

U.S. PATENT DOCUMENTS 5,212,145 5/1993 Tsuchida et al. ..... 503/207

FOREIGN PATENT DOCUMENTS 31-6875 2/1956 Japan .

*Primary Examiner*—B. Hamilton Hess

*Attorney, Agent, or Firm*—Nikaido, Marmelstein, Murray & Oram

[57] ABSTRACT

The present invention provides a heat sensitive recording material comprising a recording layer formed on a substrate and containing a colorless or light-colored basic dye and a color acceptor, the material being characterized in that the basic dye is 3-diethylamino-7-[m-(trifluoromethyl)phenylamino]fluoran and/or 3-di-n-pentylamino-6-methyl-7-phenylaminofluoran, the color acceptor being 4,4'-dihydroxydiphenylsulfone.

5 Claims, No Drawings

HEAT SENSITIVE RECORDING MATERIAL

The present invention relates to heat sensitive recording materials, and more particularly to heat sensitive recording materials which are free of background fogging and excellent in the preservability of recorded images in high-temperature environments.

Heat sensitive recording materials are well known which utilize the reaction between a colorless or light-colored basic dye and a color acceptor for producing recorded images by thermally reacting the two chromogenic substances. Such recording materials are relatively inexpensive, are usable with a recording device which is compact and free of maintenance and are therefore in use in a wide variety of fields.

For example, with the POS (Point of Sales) label system placed into production processes, it has been desired to provide heat sensitive recording materials which are usable free of background fogging even at an ambient temperature of 100° C. and outstanding in the preservability of recorded images.

Heat sensitive recording materials are generally unsatisfactory in the preservation stability of recorded images and have the drawback that the recorded images fade in a relatively short period of time especially under high-temperature conditions. Although use of various preservability improving agents has been proposed to improve the preservation stability of recorded images, the preservability improving agents heretofore proposed failed to produce satisfactory effects or were found to have another drawback, for example, of impairing whiteness even if effective for improving the preservability of recorded images under high-temperature conditions. Thus satisfactory results still remain to be achieved.

Accordingly, it is strongly desired to provide a heat sensitive recording material having a recording layer which does not permit its blank portion to become impaired in whiteness even when the material is handled under high-temperature conditions, the material further being capable of retaining recorded images with good stability.

An object of the present invention is to provide a heat sensitive recording material which is least likely to become impaired in whiteness and record density even when exposed to a high temperature of 100° C.

The above and other objects of the invention will become apparent from the following description.

The present invention provides a heat sensitive recording material comprising a recording layer formed on a substrate and containing a colorless or light-colored basic dye and a color acceptor, the material being characterized in that the basic dye is 3-diethylamino-7-[m-(trifluoromethyl)phenylamino]fluoran and/or 3-di-n-pentylamino-6-methyl-7-phenylaminofluoran, the color acceptor being 4,4'-dihydroxydiphenylsulfone.

In the present invention, we have carried out extensive research and found that the combination of a specified basic dye and a specified color acceptor provides a heat sensitive recording material which is greatly reduced in the likelihood of whiteness and recording density lowering under high-temperature conditions. Thus, the present invention has been accomplished.

The basic dye to be used in the present invention are 3-diethylamino-7-[m-(trifluoromethyl)phenylamino]-fluoran and 3-di-n-pentylamino-6-methyl-7-phenylaminofluoran. These basic dyes have the serious drawback of permitting the blank portion to undergo a great reduction in whiteness although relatively less likely to allow the recorded images to fade under high-temperature conditions. However, we have found that the combination of this basic dye with 4,4'-dihydroxydiphenylsulfone affords a heat sensitive recording material which retains the advantage of the basic dye and is yet remarkably diminished in the reduction of whiteness even under a high-temperature condition of 100° C.

It is desired that the ratio of the color acceptor to the basic dye to be used therewith be adjusted generally within the range of 50 to 1000 parts by weight, preferably about 150 to about 700 parts by weight, per 100 parts by weight of the basic dye although not limited specifically.

While the above-specified basic dye and color acceptor used in combination as the components of the chromogenic system of the present invention provide a heat sensitive recording material which is satisfactory in whiteness and recorded image preservability even if handled in high-temperature environments, it is desirable to incorporate a preservability improving agent, such as those given below, into the recording layer because the heat sensitive recording layer then available has further improved recorded image preservability in high-temperature environments.

Examples of useful preservability improving agents are 2,2'-methylenebis(4-methyl-6-tert-butylphenol), 2,2'-methylenebis(4-ethyl-6-tert-butylphenol), 2,2'-ethylidenebis-(4,6-di-tert-butylphenol), 2,2'-ethylidenebis(4-sec-butyl-6-tert-butylphenol), 4,4'-butylidenebis(6-tert-butyl-3-methylphenol), 4,4'-thiobis(6-tert-butyl-3-methylphenol), 1,1,3-tris(5-tert-butyl-4-hydroxy-2-methylphenyl)butane, 1,1,3-tris(5-cyclohexyl-4-hydroxy-2-methylphenyl)butane, 1,3,5-tris[2-(3,5-di-tert-butyl-4-hydroxyhydrocinnamoyloxy)ethyl]isocyanurate, 1,3,5-tris(4-tert-butyl-3-hydroxy-2,6-dimethylbenzyl)-isocyanurate, 1,3,5-tris(3,5-di-tert-butyl-4-hydroxybenzyl)isocyanurate, 2,4,6-tris(3',5'-di-tert-butyl-4'-hydroxybenzyl)mesitylene, pentaerythrityl-tetrakis[3-(3,5-di-tert-butyl-4-hydroxyphenyl)propionate], 4-{4-[1,1-bis(4-hydroxyphenyl)ethyl]-α,α-dimethylbenzyl}phenol, metal salt of 2,2'-methylenebis(4,6-di-tert-butylphenyl)phosphate, etc. At least two of these compounds can be used in combination as required. As metal salt of 2,2'-methylenebis(4,6-di-tert-butylphenyl)phosphate, preferable are sodium, potassium and like alkali metal salt, and a polyvalent metal salt such as magnesium, calcium, barium, zinc and aluminum salt.

Among the above preservability improving agent, preferably used are a metal salt of 2,2'-methylenebis(4,6-di-tert-butylphenyl)phosphate, 1,1,3-tris(5-tert-butyl-4-hydroxy-2-methylphenyl)butane, 1,1,3-tris (5-cyclohexyl-4-hydroxy-2-methylphenyl)butane, 1,3,5-tris[2-(3,5-di-tert-butyl-4-hydroxyhydrocinnamoyloxy)-ethyl-]isocyanurate, 1,3,5-tris(4-tert-butyl-3-hydroxy-2,6-dimethylbenzyl)isocyanurate, 1,3,5-tris(3,5-di-tert-butyl-4-hydroxybenzyl)isocyanurate and 4-{4-[1,1-bis(4-hydroxyphenyl)ethyl]-α,α-dimethylbenzyl}phenol, which exhibit particularly excellent effect in combination with the above specific basic dye and the specific color acceptor.

It is desired that the ratio of the preservability improving agent to the basic dye to be used therewith be adjusted generally within the range of 10 to 700 parts by weight, preferably about 30 to about 350 parts by weight, per 100 parts by weight of the basic dye although not limited specifically.

Further, in case of conjointly using a heat-fusible substance in order to enhance the recording sensitivity in the present invention, it is desired to use the following benzotriazole compound, which improves the recording sensitivity without affecting the contemplated effects of the invention. Examples of useful benzotriazole compounds are benzotriazole, 1-N-hydroxy-benzotriazole, 1-N-benzoylbenzotriazole, 1-N-acetyl-benzotriazole, 2-(2'-hydroxy-5'-methylphenyl)benzotriazole, 2-(2'-hydroxy-3',5'-di-tert-butylphenyl)-5-chloro-benzotriazole, 2-(2'-hydroxy-3'-tert-butyl-5'-methylphenyl)-5-chloro-benzotriazole, 2-(2'-hydroxy-3',5'-di-tert-amylphenyl)benzotriazole, 2-(2'-hydroxy-3',5'-di-tert-butylphenyl)benzotriazole, 2-(2'-hydroxy-5'-tert-butylphenyl)benzotriazole, 2-(2'-hydroxy-5'-tert-octylphenyl)benzotriazole, 2-[2'-hydroxy-3',5'-bis(benzyl)-phenyl]benzotriazole and 2-[2'-hydroxy-3',5'bis(α,α-dimethylbenzyl)phenyl]benzotriazole. Of course the benzotriazole compounds are not limited to thereabove and are used in a mixture of at least two of them as required.

Especially preferable among these benzotriazole compounds are compounds represented by the following general formula (1), more specifically those having a melting point of 100° to 160° C., preferably 100° to 150° C., since such compounds enable the specific chromogenic system of the invention to fully exhibit its characteristics and are also highly effective for giving improved recording sensitivity

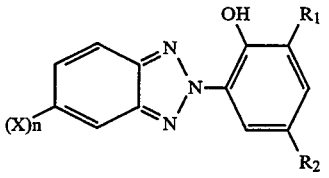

(1)

wherein $R_1$ and $R_2$ are each hydrogen atom, $C_1 \sim C_{10}$ alkyl or $C_7 \sim C_{12}$ aralkyl, X is halogen atom, n is 0 or 1.

It is desired that the ratio of the benzotriazole compound to the basic dye to be used therewith be adjusted generally within the range of 5 to 1000 parts by weight, preferably about 10 to about 500 parts by weight, per 100 parts by weight of the basic dye although not limited specifically.

As previously described, the heat sensitive recording material of the present invention has the important feature that the chromogenic system thereof comprises the specified basic dye and color acceptor. When required, it is further possible to use these components in combination with basic dyes disclosed, for example, in JP-A-353491/1992 and color acceptors disclosed, for example, in JP-A-580/1993.

In addition to the above-mentioned benzotriazole compound, also usable are other heat-fusible substances insofar as these substance are not detrimental to the contemplated effect of the present invention.

Examples of useful heat-fusible substances are stearic acid amide, stearic acid methylenebisamide, stearic acid ethylenebisamide, stearic acid methylolamide, oleic acid amide, palmitic acid amide, coconut fatty acid amide and like fatty acid amides, p-benzyldiphenyl, 1,2-bis(phenoxy)ethane, 1,2-bis(4-methylphenoxy)ethane, 1,2-(3-methylphenoxy)ethane, 2-naphthol benzyl ether, benzyl-4-methylthiophenyl ether and like ethers, dibenzyl terephthalate, 1-hydroxy-2-naphthoic acid phenyl ester, oxalic acid di-p-methylbenzyl ester, oxalic acid di-p-chlorobenzyl ester and like esters.

A coating composition is prepared from these components, for example, by dispersing the dye and color acceptor, and the benzotriazole compound and heat-fusible substance which are used when so required, into a dispersion medium which is generally water, at the same time or individually, with use of a stirring-pulverizing machine such as a ball mill, attritor, vertical or horizontal sand mill or colloid mill.

Usually a binder is incorporated into the coating composition in an amount of 2 to 40 wt, %, preferably about 5 to about 25 wt. %, based on the total solids content of the composition. Examples of useful binders are starches, hydroxyethyl cellulose, methyl cellulose, carboxymethyl cellulose, gelatin, casein, gum arabic, polyvinyl alcohol, carboxyl-modified polyvinyl alcohol, sulfo-modified polyvinyl alcohol, acetoacetyl-modified polyvinyl alcohol, silicon-modified polyvinyl alcohol and like modified polyvinyl alcohols, styrene-maleic anhydride copolymer salt, ethylene-acrylic acid copolymer salt, styrene-acrylic acid copolymer salt, styrene-butadiene copolymer emulsion, etc. At least two of these binders can of course be used in combination.

Various auxiliary agents can further be added to the coating composition. Examples of useful agents are dispersants such as sodium dioctylsulfosuccinate and metal salts of fatty acids, ultraviolet absorbers of the benzophenone, cyanoacrylate, hydroxybenzoate and like types, and other agents including defoaming agents, fluorescent dyes and coloring dyes.

To prevent the heat sensitive recording material from sticking to the recording device or recording head on contact therewith, it is possible to add to the composition a dispersion or emulsion of stearic acid ester wax, polyethylene wax, carnauba wax, microcrystalline wax, carboxyl-modified paraffin wax, zinc stearate, calcium stearate or the like.

To diminish the adhesion of tailings to the recording head, it is also possible to add to the composition an inorganic pigment such as kaolin, clay, talc, calcium carbonate, magnesium carbonate, calcined clay, titanium oxide, kieselguhr, finely divided anhydrous silica or activated clay, and organic pigment such as styrene microballs, nylon powder, polyethylene powder, urea-formalin resin filler or crude starch particles.

With the heat sensitive recording material of the invention, the method of forming the recording layer is not limited specifically. The recording layer can be formed by known conventional techniques, for example, by applying a coating composition for forming this layer to a substrate with a suitable coater, such as air knife coater, blade coater, bar coater, gravure coater or curtain coater, and drying the resulting coating.

The amount of coating composition to be applied is not limited specifically either. Generally it is adjusted to the range of 1.0 to 12 g/m$^2$, preferably 1.5 to 10 g/m$^2$, by dry weight.

While the substrate to be used is usual paper, plastics film, synthetic paper or the like, paper is the most preferable to use in view of cost and coatability.

The heat sensitive recording material of the present invention thus obtained exhibits the excellent characteristics of being greatly diminished in the reduction of whiteness and recording density even when exposed to high-temperature conditions.

When required, it is of course possible to form a protective layer over the front surface and/or rear surface of the heat sensitive recording material, or to provide an intermediate layer between the substrate and the heat sensitive recording layer. The material can further be additionally treated by various techniques known in the art of preparing heat sensitive recording materials, such as application of an adhesive thereto.

The present invention will be described in greater detail with reference to the following examples, to which the invention is not limited. The parts and percentages in these examples are by weight unless otherwise specified.

EXAMPLE 1

(1) Formation of intermediate layer

A coating composition for an intermediate layer was prepared by mixing together 100 parts of calcined clay (brand name: Ansilex, product of Engelhard Minerals & Chemicals Corp.), 15 parts of styrene-butadiene copolymer latex (solids content: 50%), 30 parts of 10% aqueous solution of polyvinyl alcohol and 200 parts of water. The coating composition obtained was applied to wood-free paper, weighing 50 g/m$^2$, in an amount of 7 g/m$^2$ when dried, followed by drying to form an intermediate layer.

(2) Preparation of Composition A

A composition comprising 10 parts of 3-diethylamino-7-[m-(trifluoromethyl)phenylamino]fluoran, 10 parts of 5% aqueous solution of methyl cellulose and 10 parts of water was pulverized to a mean particle size of 1.2 $\mu$m by a sand mill.

(3) Preparation of Composition B

A composition composed of 50 parts of 4,4'-dihydroxydiphenylsulfone, 50 parts of 5% aqueous solution of methyl cellulose and 40 parts of water was pulverized to a mean particle size of 1.4 $\mu$m by a sand mill.

(4) Formation of heat sensitive recording layer

A coating composition for forming a heat sensitive recording layer was prepared by mixing together with stirring 30 parts of Composition A, 140 parts of Composition B, 160 parts of 10% aqueous solution of polyvinyl alcohol, 35 parts of calcium carbonate and 100 parts of water. The composition obtained was applied onto the intermediate layer in an amount by dry weight of 6 g/m$^2$ and dried.

(5) Formation of protective layer

A coating composition for a protective layer was prepared from 200 parts of 10% aqueous solution of acetoacetyl-modified polyvinyl alcohol (brand name: Gohsefimer Z-200, product of the Nippon Synthetic Chemical Industry Co., Ltd.), 60 parts of kaolin (brand name: UW-90, product of Engelhard Minerals & Chemicals Corp.), 15 parts of 30% aqueous dispersion of zinc stearate and 140 parts of water by mixing these ingredients together with stirring. The coating composition obtained was applied onto the recording layer in an amount by dry weight of 3 g/m$^2$ and dried to obtain a heat sensitive recording material having a protective layer.

EXAMPLE 2

A heat sensitive recording material having a protective layer was prepared in the same manner as in Example 1 except that in preparing Composition B, 50 parts of 4,4'-dihydroxydiphenylsulfone was replaced by 40 parts of 4,4'-dihydroxydiphenylsulfone and 10 parts of a mixture (brand name: Adeka.Arkls F-85, product of Asahi Denka Kogyo Co., Ltd.) of sodium salt of 2,2'-methylenebis(4,6-di-tert-butylphenyl)phosphate and magnesium silicate.

EXAMPLE 3

A heat sensitive recording material having a protective layer was prepared in the same manner as in Example 1 except that in preparing Composition B, 50 parts of 4,4'-dihydroxydiphenylsulfone was replaced by 40 parts of 4,4'-dihydroxydiphenylsulfone and 10 parts of 1,1,3-tris(5-cyclohexyl-4-hydroxy-2-methylphenyl)butane.

EXAMPLE 4

A heat sensitive recording material having a protective layer was prepared in the same manner as in Example 1 except that in preparing Composition B, 50 parts of 4,4'-dihydroxydiphenylsulfone was replaced by 40 parts of 4,4'-dihydroxydiphenylsulfone and 10 parts of 4-{4-[1,1-bis(4-hydroxyphenyl)ethyl]-$\alpha$,$\alpha$-dimethylbenzylphenol.

EXAMPLE 5

A heat sensitive recording material having a protective layer was prepared in the same manner as in Example 1 except that in preparing Composition B, 50 parts of 4,4'-dihydroxydiphenylsulfone was replaced by 40 parts of 4,4'-dihydroxydiphenylsulfone, 5 parts of 4-{4-[1,1-bis(4-hydroxyphenyl)ethyl]-$\alpha$,$\alpha$-dimethylbenzyl}phenol and 5 parts of 2-(2'-hydroxy-5'-methylphenyl)-benzotriazole.

EXAMPLE 6

A heat sensitive recording material having a protective layer was prepared in the same manner as in Example 5 except that in preparing Composition B, 2-(2'-hydroxy-5'-methylphenyl)benzotriazole was replaced by 2-(2'-hydroxy-3'-tert-butyl-5'-methylphenyl)-5-chlorobenzotriazole.

EXAMPLE 7

A heat sensitive recording material having a protective layer was prepared in the same manner as in Example 4 except that in preparing Composition A, 3-diethylamino-7-[m-(trifluoromethyl)phenylamino]fluoran was replaced by 3-di-n-pentylamino-6-methyl-7-phenylaminofluoran.

EXAMPLE 8

A heat sensitive recording material having a protective layer was prepared in the same manner as in Example 7 except that in preparing Composition B, 4-{4-[1,1-bis(4-hydroxyphenyl)ethyl]-$\alpha$,$\alpha$-dimethylbenzyl}phenol was not used.

Comparative Example 1

A heat sensitive recording material having a protective layer was prepared in the same manner as in Example 1 except that in preparing Composition A, 3-diethylamino-7-[m-(trifluoromethyl)phenylamino]fluoran was replaced by 3-di(n-butyl)amino-7-(o-chlorophenylamino)fluoran.

Comparative Example 2

A heat sensitive recording material having a protective layer was prepared in the same manner as in Example 1 except that in preparing Composition B, 4,4'-dihydroxydiphenylsulfone was replaced by 2,4'-dihydroxydiphenylsulfone.

Comparative Example 3

A heat sensitive recording material having a protective layer was prepared in the same manner as in Example 1 except that in preparing Composition B, 4,4'-dihydroxydiphenylsulfone was replaced by 4,4'-cyclohexylidenediphenol.

Comparative Example 4

A heat sensitive recording material having a protective layer was prepared in the same manner as in Example 8 except that in preparing Composition B, 4,4'-dihydroxydiphenylsulfone was replaced by 4-hydroxy-4'-isopropoxydiphenylsulfone.

Evaluation

The twelve kinds of heat sensitive recording materials thus obtained were used on Matsushita Simulator MF-1 (applied voltage: 16 V, pulse width: 3 ms) for recording, and then checked for the color density of recorded images and the background density of blank areas by a Macbeth reflective densitometer (Model RD-914, product of Macbeth Corp.). Table 1 shows the results. The recording papers used for recording were allowed to stand in a hot air dryer at 100° C. for 24 hours and thereafter checked again for the color density of recorded images and the background density of blank areas by the Macbeth reflective densitometer to evaluate the materials in respect of the preservability of recorded images and background fogging under the high-temperature condition. The results are also given in Table 1.

TABLE 1

| | | | After high-temperature treatment | |
|---|---|---|---|---|
| | Color density | Background density | Color density | Background density |
| Ex. 1 | 1.26 | 0.06 | 1.00 | 0.10 |
| Ex. 2 | 1.27 | 0.06 | 1.11 | 0.13 |
| Ex. 3 | 1.28 | 0.06 | 1.05 | 0.12 |
| Ex. 4 | 1.27 | 0.06 | 1.17 | 0.12 |
| Ex. 5 | 1.38 | 0.06 | 1.24 | 0.13 |
| Ex. 6 | 1.35 | 0.06 | 1.22 | 0.13 |
| Ex. 7 | 1.28 | 0.06 | 1.05 | 0.15 |
| Ex. 8 | 1.26 | 0.06 | 0.96 | 0.12 |
| Com. Ex. 1 | 1.13 | 0.05 | 0.50 | 0.10 |
| Com. Ex. 2 | 1.27 | 0.07 | 1.07 | 0.31 |
| Com. Ex. 3 | 1.28 | 0.06 | 0.78 | 0.25 |
| Com. Ex. 4 | 1.41 | 0.07 | 1.35 | 0.90 |

The results given in Table 1 reveal that the heat sensitive recording materials obtained in the examples of the invention were very small in the reduction of whiteness and of recording density even when held under the high-temperature condition, hence excellent recording materials.

We claim:

1. A heat sensitive recording material comprising a recording layer formed on a substrate and containing a colorless or light-colored basic dye and a color acceptor, the material being characterized in that the basic dye is 3-diethylamino-7-[m-(trifluoromethyl)-phenylamino]fluoran and/or 3-di-n-pentylamino-6-methyl-7-phenylaminofluoran, the color acceptor being 4,4'-dihydroxydiphenylsulfone.

2. A heat sensitive recording material as defined in claim 1 wherein further a preservability improving agent is incorporated in the recording layer.

3. A heat sensitive recording material as defined in claim 2 wherein the preservability improving agent is at least one compound selected from the group consisting of a metal salt of 2,2'-methylenebis(4,6-di-tert-butylphenyl)phosphate, 1,1,3-tris(5-tert-butyl-4-hydroxy-2-methylphenyl)butane, 1,1,3-tris(5-cyclohexyl-4-hydroxy-2-methylphenyl)butane, 1,3,5-tris[2-(3,5-di-tert-butyl-4-hydroxyhydrocinnamoyloxy)ethyl-]isocyanurate, 1,3,5-tris(4-tert-butyl-3-hydroxy-2,6-dimethylbenzyl)-isocyanurate, 1,3,5-tris(3,5-di-tert-butyl-4-hydroxybenzyl)isocyanurate and 4-{4-[1,1-bis(4-hydroxyphenyl)ethyl]-α,α-dimethylbenzyl} phenol.

4. A heat sensitive recording material as defined in claim 1 wherein further, as a heat-fusible substance, a benzotriazole compound is incorporated in the recording layer.

5. A heat sensitive recording material as defined claim 4 wherein the benzotriazole compound is at least one compound represented by the formula (1)

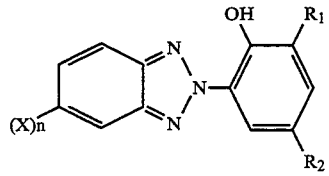

(1)

wherein $R_1$ and $R_2$ are each hydrogen atom, $C_1 \sim C_{10}$ alkyl or $C_7 \sim C_{12}$ aralkyl, X is halogen atom, n is 0 or 1.

* * * * *